US007793608B1

(12) United States Patent
Udouj

(10) Patent No.: US 7,793,608 B1
(45) Date of Patent: Sep. 14, 2010

(54) RESERVE SHEET MATERIAL ROLL WITH LOW SUPPLY INDICATOR

(76) Inventor: John C. Udouj, 9761 Thistle Ct., Fort Smith, AR (US) 72908

( * ) Notice: Subject to any disclaimer, the term of this patent is extended or adjusted under 35 U.S.C. 154(b) by 76 days.

(21) Appl. No.: 12/221,067

(22) Filed: Jul. 30, 2008

Related U.S. Application Data

(63) Continuation-in-part of application No. 11/030,469, filed on Jan. 6, 2005, now abandoned.

(51) Int. Cl.
*B65H 18/28* (2006.01)

(52) U.S. Cl. ..... 116/200; 242/912; 242/165

(58) Field of Classification Search ..... 116/200; 242/912, 164–167, 565, 118.3, 118.32, 160.1–160.4, 242/563, 563.2, 600; 221/2, 6, 10, 11, 14; 270/52.02; 40/309
See application file for complete search history.

(56) References Cited

U.S. PATENT DOCUMENTS

| | | | | | |
|---|---|---|---|---|---|
| 610,339 | A | | 9/1898 | Atherton | 400/615.2 |
| 1,510,648 | A | * | 10/1924 | Borroughs | 312/34.9 |
| 1,935,970 | A | | 11/1933 | Wooster et al. | 116/114 |
| 2,555,205 | A | | 5/1951 | Steffens | 206/46 |
| 4,111,378 | A | | 9/1978 | Barwick | 242/57 |
| 4,161,249 | A | | 7/1979 | Dashow | 206/459 |
| 4,195,787 | A | * | 4/1980 | Thomason | 40/360 |
| 4,901,663 | A | | 2/1990 | De Luca | 116/200 |
| 4,925,214 | A | | 5/1990 | Hazelton et al. | 283/62 |
| 5,255,861 | A | | 10/1993 | Lerner | 242/55.2 |
| 5,365,874 | A | | 11/1994 | Dorfman | 116/200 |
| 5,474,249 | A | | 12/1995 | Koizumi et al. | 242/526 |
| 5,609,269 | A | | 3/1997 | Behnke et al. | 221/48 |
| 5,813,619 | A | * | 9/1998 | Robertson | 242/160.4 |
| 5,816,165 | A | | 10/1998 | Huston | 101/490 |
| 5,855,714 | A | * | 1/1999 | Bockh | 156/157 |
| 6,089,483 | A | * | 7/2000 | St-Laurent | 242/160.4 |
| 6,282,807 | B1 | | 9/2001 | Johnson | 33/733 |
| 6,607,110 | B2 | | 8/2003 | Nusbaum | 225/43 |
| 6,631,574 | B2 | * | 10/2003 | Okyere | 40/309 |
| 6,898,881 | B2 | * | 5/2005 | Morrison | 40/299.01 |

* cited by examiner

*Primary Examiner*—Amy Cohen Johnson
(74) *Attorney, Agent, or Firm*—Keisling & Pieper, PLC; David B. Pieper

(57) ABSTRACT

A sheet material supply roll wrapped on a core tube including a reserve segment of sheet material spirally wrapped around the core tube with a supply segment of sheet material spirally wrapped on top of the reserve segment of sheet material. Different methods for placement or attachment of the roll ends are provided including perforated, overlapping, spaced, and integrated flap methods and apparatus. Further, a cross oriented low supply indicator is provided on the supply roll to provide a quick indicator of the end of roll without disrupting the remaining integrity of the supply.

18 Claims, 7 Drawing Sheets

RESERVE SHEET MATERIAL ROLL WITH LOW SUPPLY INDICATOR

CROSS-REFERENCE TO RELATED APPLICATIONS

This application claims priority to and is a continuation-in-part of U.S. application Ser. No. 11/030,469, filed Jan. 6, 2005 now abandoned.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of sheet material supply. In particular, the present invention relates specifically to providing a reserve supply and an indicator of the reserve in a sheet material supply roll. Known art may be found in U.S. Class 242, Subclass 118.3, 118.32, 160.1, 160.2, 160.3, 160.4, 166, 167, 563, 563.2, and 912 as well as in other classes and subclasses.

2. Description of the Known Art

Patents disclosing relevant information include: U.S. Pat. No. 610,339 issued to Atherton on Sep. 6, 1898; U.S. Pat. No. 1,935,970 issued to Wooster on Nov. 21, 1933; U.S. Pat. No. 4,111,378 issued to Barwick on Sep. 5, 1978; U.S. Pat. No. 4,161,249 issued to Dashow on Jul. 17, 1979; U.S. Pat. No. 4,901,663 issued to De Luca on Feb. 20, 1990; U.S. Pat. No. 4,925,214 issued to Hazelton on May 15, 1990; U.S. Pat. No. 5,365,874 issued to Dorfman on Nov. 22, 1994; U.S. Pat. No. 5,474,249 issued to Koizumi on Dec. 12, 1995; U.S. Pat. No. 5,816,165 issued to Huston on Oct. 6, 1998; U.S. Pat. No. 6,282,807 issued to Johnson on Sep. 4, 2001; and U.S. Pat. No. 6,607,110 issued to Nusbaum on Aug. 19, 2003. Each of these patents are hereby expressly incorporated by reference in their entirety.

U.S. Pat. No. 610,339 issued to Atherton on Sep. 6, 1898 discloses a solid paper based telegraph tape with certain marks or indications which will call to the operators attention to the fact that the end of the coil of tape is approaching.

U.S. Pat. No. 4,111,378 issued to Barwick on Sep. 5, 1978 discloses a ink ribbon spool roll with the end portion wound in one direction and the rest of the roll in another. When the end of the roll is approaching the roll changes direction giving the user indication that the end is near.

U.S. Pat. No. 5,365,874 issued to Dorfman on Nov. 22, 1994 discloses dental floss with an indicator. The indicator is described as a length of tape having a different color or appearance than the rest of the roll. In the drawings number 38, 40 are relevant.

It is also known to color along the side of a strip of adding machine paper to indicate the approach of the end of a roll. This side coloring provides a problem to consumers in that a new receipt cannot be printed with a clear copy for the customer without actually changing the roll of material to one that has not yet reached the red coloring portion. The typical red dye used to color the paper means that the receipt cannot be copied for expense reports or other reproductive necessities. In addition to these problems, the knowledge of changing color of a segment of material has stayed limited to the paper and solid object fields of endeavor and has not been recognized for its use in other applications such as translucent wrap.

What is not known is the deliberate packaging of an extended length of material on a roll over a separate reserve segment with the reserve segment having a changing indicator. Thus, it may be seen that these prior art patents are very limited in their teaching and utilization, and an improved roll supply is needed to overcome these limitations.

SUMMARY OF THE INVENTION

The present invention is directed to improved sheet material supply based on an observation of consumer behavior and frustration with depleting a quantity of clear plastic wrap. Because clear plastic wrap has advanced in its construction and obtained such clarity and the thickness of the material has become so thin, consumers are unable to gauge when the roll is running low or even when the last few inches of material are about to run off of the spool. This same problem also exists with other sheet materials such as aluminum foil. Thus, the present invention is directed to solving this basic need.

The basic idea is to provide two separate quantities of material on the same roll with a reserve having an indicator that the reserve is in use. For example, consider a consumer that has run out of the main supply of material, such as a plastic wrap. Instead of being frustrated at the depletion of the material supply, the present invention would provide a separate section of material on the same roll. This reserve of material may have a different color, design or pattern, or simply have an indicator such as a stripe running down the middle of the reserve indicating that the reserve is now in use and that the main material supply needs to be replenished. A sleeve separating the supply of material may be provided or the material may be joined in various different methods including, perforation, but joint, overlapping joints, or an integrated flap joint. A further improvement may be found in the use of a changing indicator that changes in color, shape, or intensity as the end of the reserve wrap approaches.

In accordance with one exemplary embodiment of the present invention, a sheet material supply device is provided using a core tube with a reserve segment of sheet material spirally wrapped around the core tube and a supply segment of sheet material spirally wrapped on the reserve segment of sheet material. The reserve segment has a reserve length and the supply segment has a supply length greater then the reserve length. Additional elements for the invention include the inclusion of the reserve segment having a reserve indicator and indicators on the end of the supply segment. Also taught are various connections or wrapping methods between the supply and reserve segments including a perforated end connection; a butted end connection; an end separation gap; overlapping ends; distinct end flaps; and interlocking flaps.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
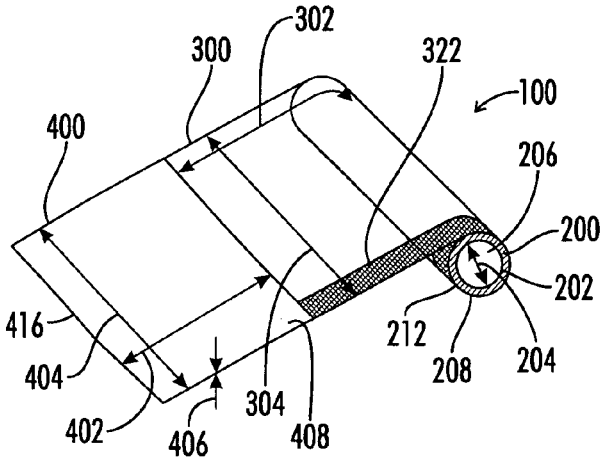
FIG. 1 is a schematic view of a material roll with a supply segment and a reserve segment with a reserve segment indicator along the side of the reserve segment.

The present invention is directed to inventive aspects of supplying two separate quantities of material on the same roll to reduce consumer frustration and aggravation from the depletion of plastic wrap from a roll. The present invention allows a user to deplete the initial supply of material such as 100' of clear plastic wrap, aluminum foil, wax paper, etc., and then have a separate reserve segment such as a 5' section still on the roll to notify the user of the depletion of material and the need to replenish the supply without aggravating the customer by a complete material depletion. The reserve segment may have a notice associated with it such as a change in color, a stripe, or other design or pattern to indicate that the reserve of material is in use. The material rolls may be separated by a paper sleeve separating the two quantities of material or various end configurations may be provided. These ideas are explained in detail by the following detailed description.

FIGS. 1 through 17 of the drawings show the application of the present invention on the preferred embodiment material of clear plastic wrap. These exemplary embodiments of the present invention are generally shown as a sheet material supply device 100 having a core tube 200 supporting a reserve segment 300 and a supply segment 400. The invention provides for this reserve segment 300 as a reserve of material on the roll 100 to be held until the supply segment 400 is depleted. The reserve segment 300 of sheet material is spirally wrapped around the core tube 200 for its reserve length 302. The supply segment 400 of sheet material is then spirally wrapped on the reserve segment 300 of sheet material. In the preferred embodiment, the supply segment 400 has a supply length 402 greater than the reserve length 302.

The core tube 200 is shown having an inner bore 202 defining an inner diameter 204 with a bore face 206. The core tube 200 also defines an outer shell 208 with an outer diameter 210 and a diameter face 212 on which the reserve of material is wrapped. The core tube 200 has a core width 214 with core sides 216, 220 with each side having a side face 218, 222.

The reserve segment 300 of sheet material is provided with a reserve length 302 and a reserve width 304 where the reserve width is associated with the core width 214. The reserve segment also has a reserve thickness 306 associated with the particular type of sheet material being supplied. The reserve segment defines an inner reserve end 308 and an outer reserve end 310 and the outer reserve end 310 may define a reserve end flap 312 formed from a reserve flap crease 314. The reserve end flap has a reserve flap length 316 of approximately one quarter to one half inch. The sheet material for the reserve segment 300 has a first reserve side 318 and a second reserve side 320. The reserve indicator 322 may be printed on either the first reserve side 318 or the second reserve side 320, or impregnated into the material to indicate that the reserve of material is being utilized.

Figure 2:
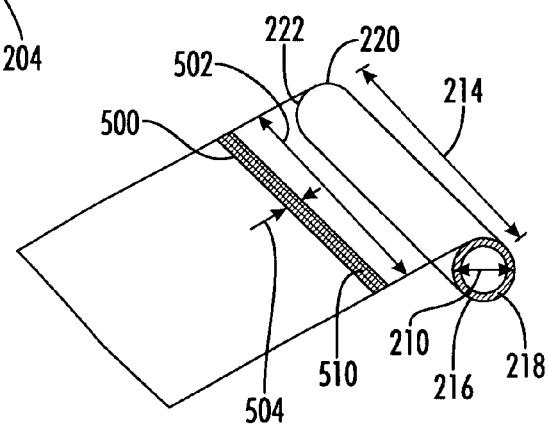
FIG. 2 is a schematic view of an alternative embodiment of a material roll with a supply segment and a reserve segment with an across segment indicator along the end of the reserve segment.
Figure 3:
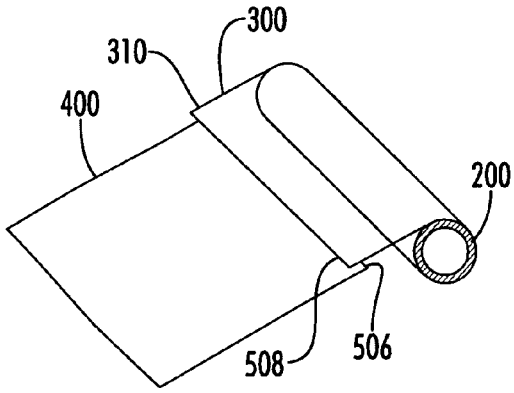
FIG. 3 is a schematic view of a material roll with a supply segment and a reserve segment with an underlapping connection joint.
Figure 4:
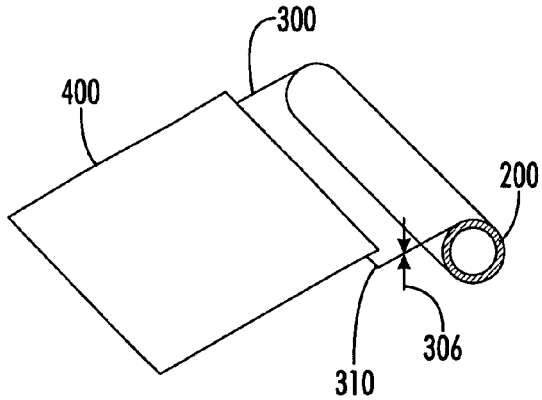
FIG. 4 is a schematic view of a material roll with a supply segment and a reserve segment with an overlapping connection joint.
Figure 5:
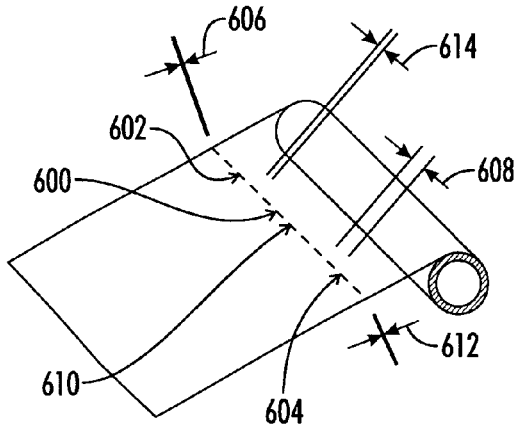
FIG. 5 is a schematic view of a material roll with a supply segment and a reserve segment with a perforated connection joint.
Figure 6:
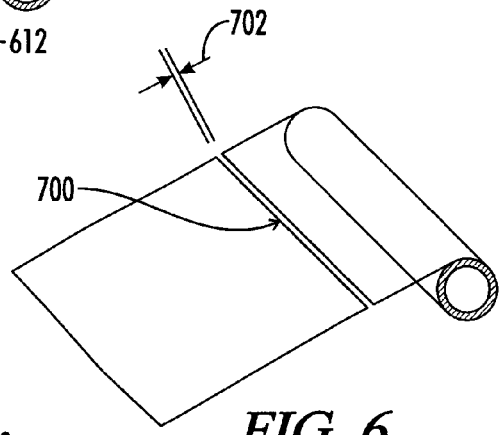
FIG. 6 is a schematic view of a material roll with a supply segment and a reserve segment with a separating gap connection joint.
Figure 7:
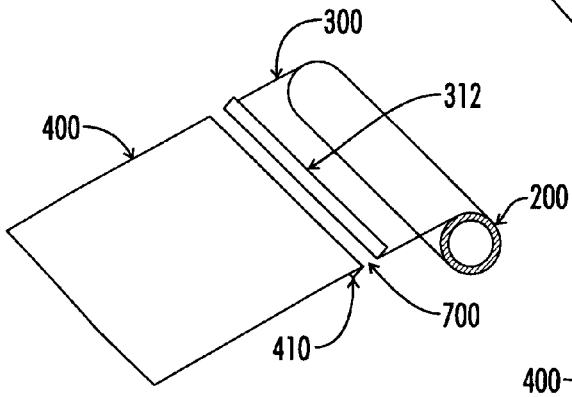
FIG. 7 is a schematic view of a material roll with a supply segment and a reserve segment with a gap separated flap connection joint.
Figure 8:
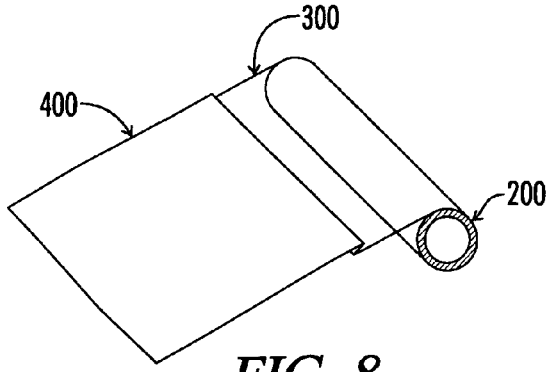
FIG. 8 is a schematic view of a material roll with a supply segment and a reserve segment with a flap connection joint.
Figure 9:
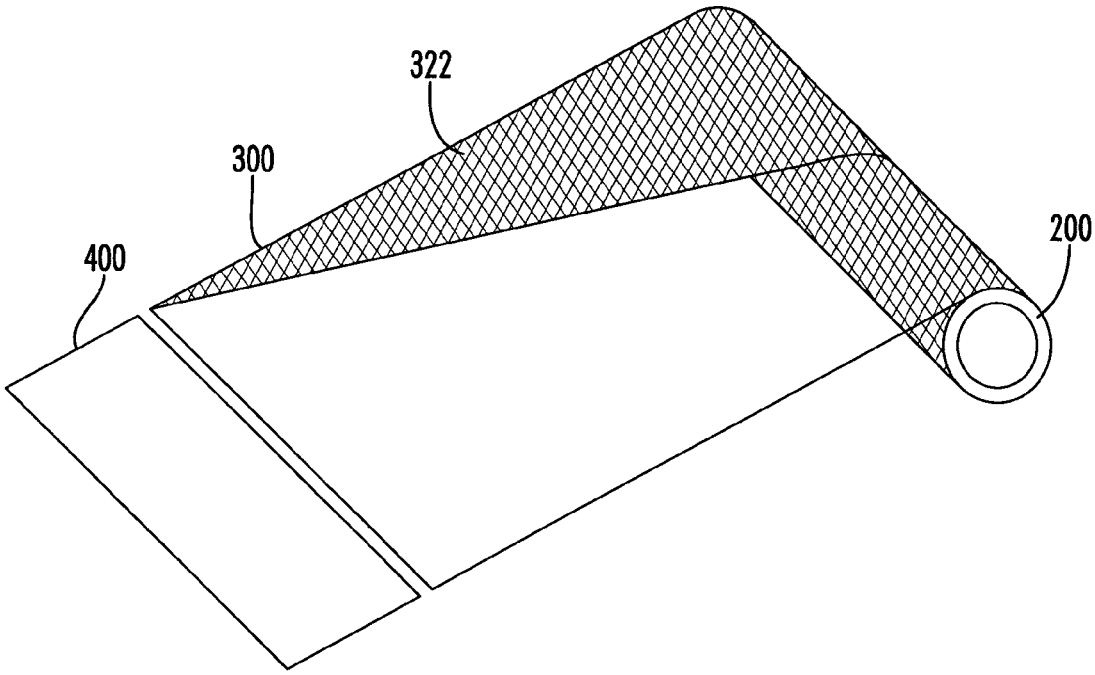
FIG. 9 is a schematic view of a material roll with a supply segment and a reserve segment with an increasing width reserve indicator.
Figure 10:
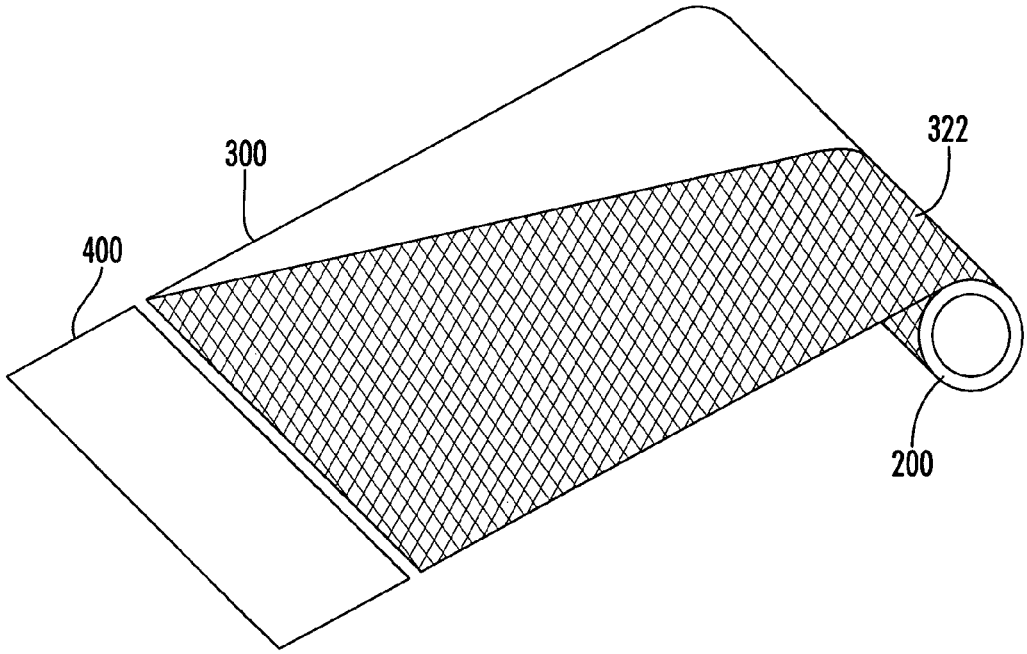
FIG. 10 is a schematic view of a material roll with a supply segment and a reserve segment with a decreasing width reserve indicator.
Figure 11:
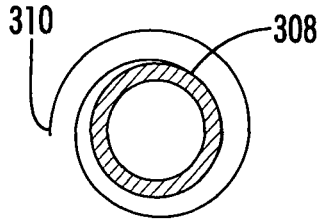
FIG. 11 is a schematic view of a material roll with a reserve segment wound on a core.
Figure 12:
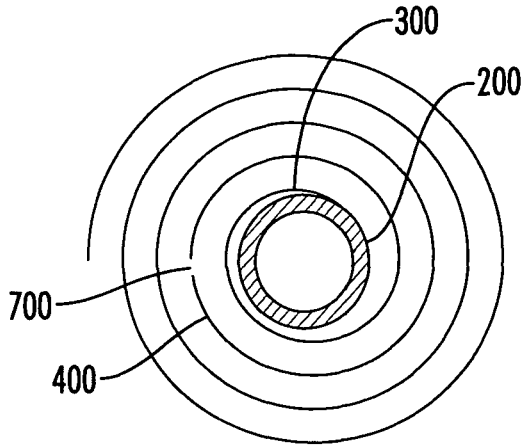
FIG. 12 is a schematic view of a material roll with a supply segment wound over a reserve segment wound on a core with a separating gap joint.
Figure 13:
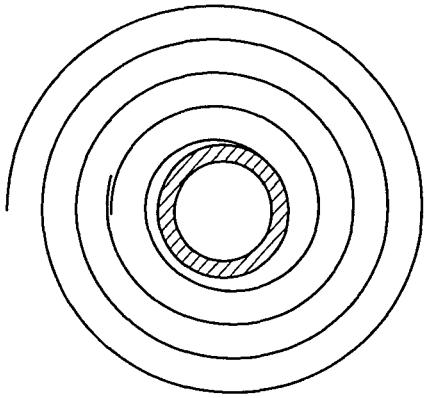
FIG. 13 is a schematic view of a material roll with a supply segment wound over a reserve segment wound on a core with an overlapping gap joint.
Figure 14:
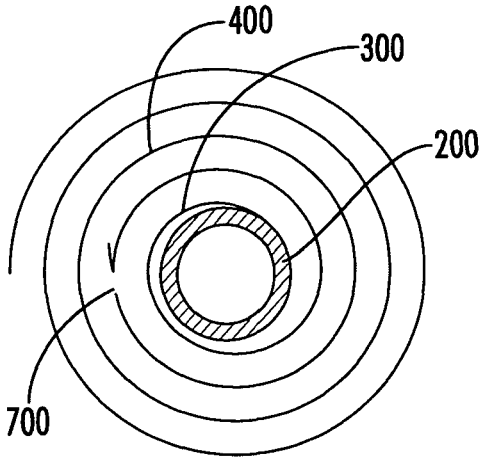
FIG. 14 is a schematic view of a material roll with a supply segment wound over a reserve segment wound on a core with a reserve flap separating gap joint.
Figure 15:
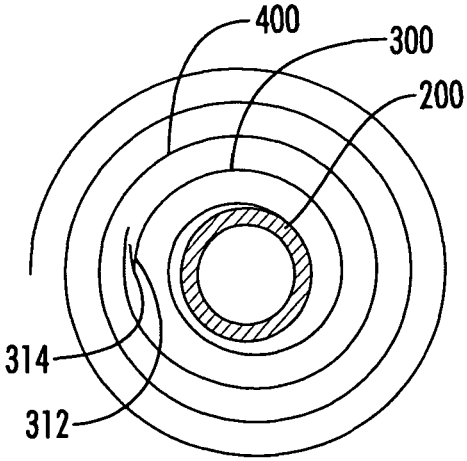
FIG. 15 is a schematic view of a material roll with a supply segment wound over a reserve segment wound on a core with a reserve flap overlapping gap joint.
Figure 16:
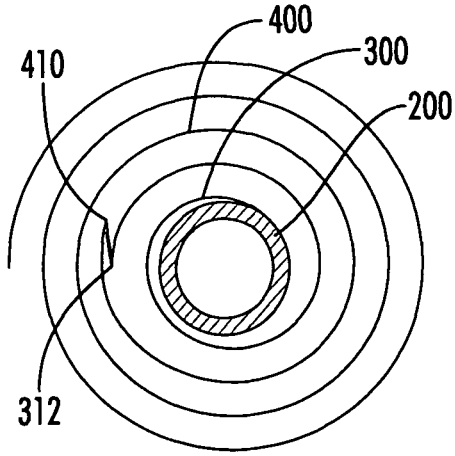
FIG. 16 is a schematic view of a material roll with a supply segment wound over a reserve segment wound on a core with an interlocking flap.
Figure 17:
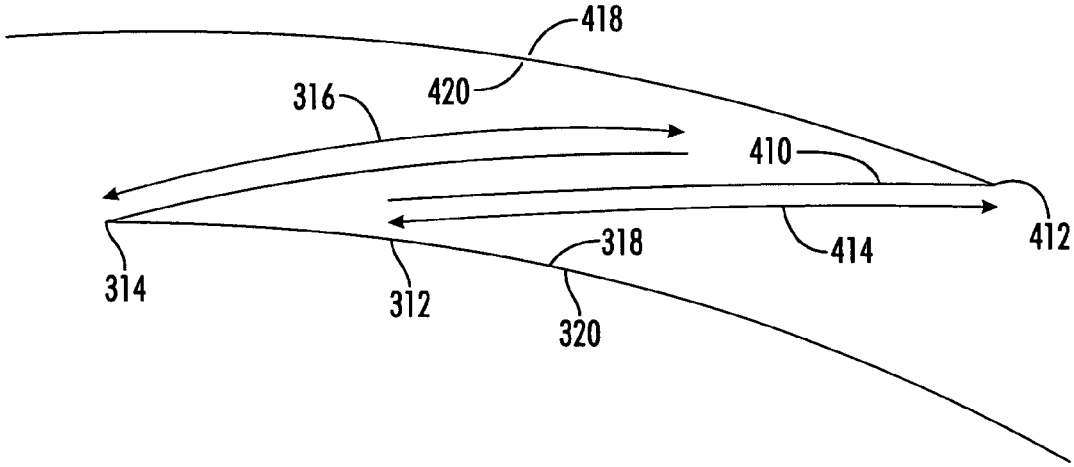
FIG. 17 is an expanded view of the overlapping interlocking flap joint of FIG. 16.
Figure 18:
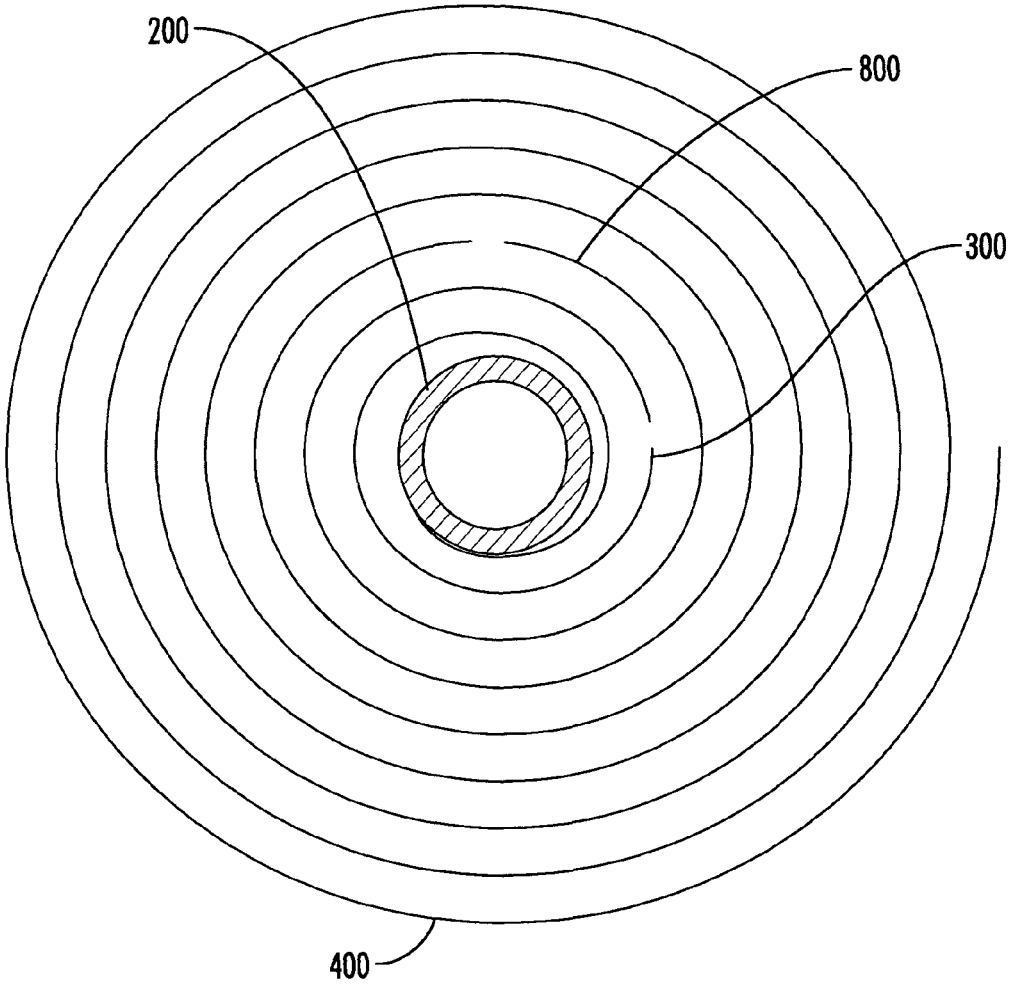
FIG. 18 is a schematic view of the separating sheet joint.

The reserve indicator 322 is shown in various forms. FIG. 1 of the drawings shows the indicator as a side stripe along the length of the reserve segment 300. This allows the user to be constantly reminded when the reserve segment 300 is in use. FIG. 2 shows the indicator as a cross stripe which provides an initial indication that the reserve segment has been reached. Additional cross stripes may be used for repetitive reminders. FIG. 9 shows the increasing width reserve indicator 322. This indicator provides the user with an indication of the amount of material left by looking at the unwound sheet while still providing a constant reminder. FIG. 10 shows a decreasing width reserve indicator 322 which provides the consistent reminder that the reserve segment 300 is in use to the user while also providing the ability to discern the amount of material by looking at the unwound sheet. Even better, this embodiment allows the user to look at the unwound roll and discern the amount of material remaining by the position of the color or indicator change on the width of the core tube 200. Because the preferred embodiment uses a typical brown cardboard tube and the clear plastic allows one to see this tube, the contrasting color of the indicator, such as a red dyed segment, allows the user to easily see the estimated amount of the reserve material that is left on the roll. Note that this could also be used on a regular roll to provide a constant reminder of the amount of material remaining.

The reserve segment 300 may be covered by a separator sheet 800 made out of a contrasting material, such as paper for a roll of plastic wrap, that may be wrapped onto the reserve segment 300 as a reserve indicator 322. However, in the preferred embodiment the supply segment 400 is wrapped directly onto the reserve segment 300 and the reserve indicator 322 is integrated into the plastic wrap being supplied.

As noted above, the supply segment 400 is wrapped over the reserve segment 300. The supply segment 400 has a supply length 402, a supply width 404, and a supply thickness 406 defining the sheet material. The supply segment 400 has an inner supply end 408 which may define a supply end flap 410. As with the reserve end flap 312 the supply end flap 410 includes a supply flap crease 412 with a supply flap length 414 to interlock with the reserve end flap 312. The supply segment 400 end in an outer supply end 416 and may cling to itself with appropriate sheet materials or may be secured by tape, an enclosing tube, or other means. The supply segment 400 defines a first supply side 418 and a second supply side 420.

The preferred methods of joining the supply segment 400 and the reserve segment 300 interlocks the supply end flap 410 into the reserve end flap 312. In this manner, the depletion of the supply segment 400 will pull the initial end 310 of the reserve segment out off of the roll while separating the supply segment from the reserve segment. This allows the user to receive notice of the depletion of the supply segment while the end of the reserve segment is presented for use. This provides the notice to the user while providing convenient access to the reserve segment 300 of material.

Either or both of the supply, segment 400 and reserve segment 300 may also include a indicator, 322 means such as coloring, shading, striping, patterns, texture or other indicators of change between the segments. An indicator may also be used to gauge the depletion of the supply with or without the reserve material. The preferred embodiment uses a stripe 500 having a stripe width 502 and a stripe length 504 positioned at either the supply transition edge 506 or the reserve transition edge 508. The stripe 500 is designed with a stripe contrasting characteristic 510 such that it stands out as an indicator of the depletion of the supply segment 400 or the beginning of the reserve segment 300.

An alternative connections between the supply segment 400 and the reserve segment 300 is a perforated end connection 600. The perforated end connection 600 uses a perforation pattern 602 having perforation apertures 604 with each of the apertures 604 having a perforation length 606 and a perforation width 608. Remaining segments between the apertures 604 are shown as material bridges 610 with each having a bridge length 612 and a bridge width 614. The perforation length 606 and bridge length 612 are shown along the length of the roll 100 and the perforation width 608 and bridge width 614 are shown across the width of the roll 100.

Yet a further method is to separate the ends of the supply segment 400 and the reserve segment 300 with an end separation gap 700. The end separation gap is defined with a gap length 702 defining the space between the supply end 408 and the reserve end 310. The preferred embodiment of this particular method uses an end separation gap of one quarter to one half inch.

Reference numerals used throughout the detailed description and the drawings correspond to the following elements:

A sheet material supply device 100
a core tube 200
an inner bore 202
an inner diameter 204
a bore face 206
an outer shell 208
an outer diameter 210
a diameter face 212
a core width 214
a first core side 216
a first side face 218
a second core side 220
a second side face 222
a reserve segment 300
a reserve length 302
a reserve width 304
a reserve thickness 306
an inner reserve end 308
an outer reserve end 310
a reserve end flap 312
a reserve flap crease 314
a reserve flap length 316
a first reserve side 318
a second reserve side 320
a reserve indicator 322
a supply segment 400
a supply length 402
a supply width 404
a supply thickness 406
an inner supply end 408
a supply end flap 410
a supply flap crease 412
a supply flap length 414
an outer supply end 416
a first supply side 418
a second supply side 420
a stripe 500
a stripe width 502
a stripe length 504
a supply transition edge 506
a reserve transition edge 508
a stripe contrasting characteristic 510
a perforated end connection 600
perforation pattern 602
perforation aperture 604
perforation length 606
perforation width 608
material bridge 610
bridge length 612
bridge width 614
an end separation gap 700
a gap length 702
separator sheet 800

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A sheet material supply apparatus, comprising:

a single core tube;

a reserve segment of first sheet material having an inner reserve end placed against the single core tube and a reserve length spirally wrapped around the single core tube, the reserve length ending in an outer reserve end, the reserve segment removable from the single core tube;

a separator sheet made out of a second contrasting material wrapped onto the reserve segment; and a separate supply segment of first sheet material spirally wrapped on the reserve segment of first sheet material on the single core tube, the supply segment having a supply length greater than the reserve length.

2. The apparatus of claim 1, the reserve segment having a reserve indicator.

3. The apparatus of claim 1, the supply segment having an inner supply end, the inner supply end and the outer reserve end butted together.

4. The apparatus of claim 1, the supply segment having an inner supply end, the inner supply end spaced from the outer reserve to define an end separation gap.

5. The apparatus of claim 1, the supply segment having an inner supply end, the inner supply end overlapping the outer reserve end.

6. The apparatus of claim 1, the supply segment having an inner supply end, the outer reserve end overlapping the inner supply end.

7. The apparatus of claim 1, the supply segment having an inner supply end, the outer reserve end folded back to define a reserve end flap.

8. The apparatus of claim 1, the supply segment having an inner supply end, the inner supply end folded back to define a supply end flap.

9. The apparatus of claim 1, the supply segment having an inner supply end;

the outer reserve end folded to define a reserve end flap;

the inner supply end folded to define a supply end flap; and the reserve end flap and the supply end flap interlocking the supply segment to the reserve segment.

10. A sheet material supply apparatus, comprising:

a single core tube;

a reserve segment of first sheet material having an inner reserve end placed against the single core tube and a reserve length spirally wrapped around the single core tube, the reserve length ending in an outer reserve end, the reserve segment removable from the single core tube;

a separator sheet made out of a second contrasting material wrapped onto the reserve segment; and a separate supply segment of first sheet material having a longer second length spirally wrapped on the reserve segment of first sheet material on the single core tube, the supply segment having an inner supply end with a stripe integrated across the inner supply end.

11. The apparatus of claim 10, the supply segment having an inner supply end, the inner supply end and the outer reserve end butted together.

12. The apparatus of claim 10, the supply segment having an inner supply end, the inner supply end spaced from the outer reserve to define an end separation gap.

13. The apparatus of claim 10, the supply segment having an inner supply end, the inner supply end overlapping the outer reserve end.

14. The apparatus of claim 10, the supply segment having an inner supply end, the outer reserve end overlapping the inner supply end.

15. The apparatus of claim 10, the supply segment having an inner supply end, the outer reserve end folded back to define a reserve end flap.

16. The apparatus of claim 10, the supply segment having an inner supply end, the inner supply end folded back to define a supply end flap.

17. The apparatus of claim 10, the supply segment having an inner supply end;

the outer reserve end folded to define a reserve end flap;

the inner supply end folded to define a supply end flap; and the reserve end flap and the supply end flap interlocking the supply segment to the reserve segment.

18. A first sheet material supply apparatus, comprising:

a core tube;

a reserve segment of first sheet material spirally wrapped around the core tube and removable from the core tube, the reserve segment having an outer reserve end folded to define a reserve end flap;

a separator sheet made out of a second contrasting material partially wrapped onto the reserve segment; and a separate supply segment of first sheet material spirally wrapped on the reserve segment of first sheet material, the supply segment having an inner supply end folded to define a supply end flap; and the reserve end flap and the supply end flap interlocking the supply segment to the reserve segment.

* * * * *